US009650918B2

(12) United States Patent
Burdgick et al.

(10) Patent No.: US 9,650,918 B2
(45) Date of Patent: May 16, 2017

(54) AUSTENITIC SEGMENT FOR STEAM TURBINE NOZZLE ASSEMBLY, AND RELATED ASSEMBLY

(71) Applicant: General Electric Company, Schenectady, NY (US)

(72) Inventors: Steven Sebastian Burdgick, Schenectady, NY (US); Salvador Mata Lopez, Queretaro (MX)

(73) Assignee: General Electric Company, Schenectady, NY (US)

( * ) Notice: Subject to any disclaimer, the term of this patent is extended or adjusted under 35 U.S.C. 154(b) by 319 days.

(21) Appl. No.: 14/584,417

(22) Filed: Dec. 29, 2014

(65) Prior Publication Data

US 2016/0186610 A1 Jun. 30, 2016

(51) Int. Cl.
*F01D 25/24* (2006.01)

(52) U.S. Cl.
CPC ..... *F01D 25/246* (2013.01); *F05D 2220/31* (2013.01)

(58) Field of Classification Search
CPC ..... F01D 25/246; F01D 25/26; F01D 25/265; F01D 25/243; F01D 9/041; F01D 9/042; F05D 2220/31
USPC ..... 415/209.2, 136, 138, 139, 209.3, 209.4
See application file for complete search history.

(56) References Cited

U.S. PATENT DOCUMENTS

| | | | | |
|---|---|---|---|---|
| 2,905,434 | A * | 9/1959 | Hertl | F01D 9/06 415/202 |
| 3,021,110 | A * | 2/1962 | Rankin | F01D 9/042 285/187 |
| 6,964,554 | B2 * | 11/2005 | Groenendaal | F01D 9/041 415/136 |
| 7,874,795 | B2 | 1/2011 | Burdgick et al. | |
| 8,702,385 | B2 | 4/2014 | Burdgick et al. | |
| 2014/0154070 | A1 | 6/2014 | Reid et al. | |
| 2015/0050134 | A1 * | 2/2015 | Shurrock | F01D 9/02 415/191 |

* cited by examiner

*Primary Examiner* — Dwayne J White
*Assistant Examiner* — Topaz L Elliott
(74) *Attorney, Agent, or Firm* — Ernest G. Cusick; Hoffman Warnick LLC

(57) ABSTRACT

An austenitic segment for a steam turbine nozzle assembly, along with related assemblies. Various embodiments include a steam turbine austenitic ring segment having: a body portion sized to substantially fill a pocket in a steam turbine outer diaphragm ring, the body portion having a greater circumferential length than an axial depth or a radial width thereof; and a hook-shaped portion extending radially inward from the body portion, the hook-shaped portion sized to engage a hook-shaped slot in the steam turbine outer diaphragm ring, wherein the body portion and the hook-shaped portion form a unitary structure.

20 Claims, 6 Drawing Sheets

AUSTENITIC SEGMENT FOR STEAM TURBINE NOZZLE ASSEMBLY, AND RELATED ASSEMBLY

BACKGROUND OF THE INVENTION

The subject matter disclosed herein relates to a steam turbine nozzle assembly, or diaphragm stage. Specifically, the subject matter disclosed herein relates to an austenitic segment design for a steam turbine nozzle assembly.

Steam turbines include static nozzle assemblies that direct flow of a working fluid into turbine buckets connected to a rotating rotor. The nozzle construction (including a plurality of nozzles, or "airfoils") is sometimes referred to as a "diaphragm" or "nozzle assembly stage." Steam turbine diaphragms include two halves, which are assembled around the rotor, creating horizontal joints between these two halves. Each turbine diaphragm stage is vertically supported by support bars, support lugs or support screws on each side of the diaphragm at the respective horizontal joints. The horizontal joints of the diaphragm also correspond to horizontal joints of the turbine casing, which surrounds the steam turbine diaphragm.

BRIEF DESCRIPTION OF THE INVENTION

An austenitic segment for a steam turbine nozzle assembly, along with related assemblies, are disclosed. Various embodiments include a steam turbine austenitic ring segment having: a body portion sized to substantially fill a pocket in a steam turbine outer diaphragm ring, the body portion having a greater circumferential length than an axial depth or a radial width thereof; and a hook-shaped portion extending radially inward from the body portion, the hook-shaped portion sized to engage a hook-shaped slot in the steam turbine outer diaphragm ring, wherein the body portion and the hook-shaped portion form a unitary structure.

A first aspect of the disclosure includes: a steam turbine austenitic ring segment having: a body portion sized to substantially fill a pocket in a steam turbine outer diaphragm ring, the body portion having a greater circumferential length than an axial depth or a radial width thereof; and a hook-shaped portion extending radially inward from the body portion, the hook-shaped portion sized to engage a hook-shaped slot in the steam turbine outer diaphragm ring, wherein the body portion and the hook-shaped portion form a unitary structure.

A second aspect of the disclosure includes a steam turbine nozzle assembly having: a turbine casing; a semi-annular diaphragm segment having an outer ring, the semi-annular diaphragm segment at least partially housed within the turbine casing, the semi-annular diaphragm segment having a horizontal joint surface and a pocket below the horizontal joint surface, the pocket including a main pocket and at least one hook-shaped slot extending from the main pocket; and an austenitic ring segment coupled with the semi-annular diaphragm segment, the austenitic ring segment having: a body portion sized to substantially fill the main pocket in the outer ring, the body portion having a greater circumferential length than an axial depth or a radial width thereof; and a hook-shaped portion extending from the body portion radially inward, the hook-shaped portion sized to engage the hook-shaped slot in the outer ring, wherein the body portion and the hook-shaped portion form a unitary structure.

A third aspect of the disclosure includes a steam turbine having: a rotor; a turbine casing at least partially surrounding the rotor; a semi-annular diaphragm segment having an outer ring, the semi-annular diaphragm segment at least partially housed within the turbine casing around the rotor, the semi-annular diaphragm segment having a horizontal joint surface and a pocket below the horizontal joint surface, the pocket including a main pocket and at least one hook-shaped slot extending from the main pocket; and an austenitic ring segment coupled with the semi-annular diaphragm segment, the austenitic ring segment having: a body portion sized to substantially fill the main pocket in the outer ring, the body portion having a greater circumferential length than an axial depth or a radial width thereof; and a hook-shaped portion extending from the body portion radially inward, the hook-shaped portion sized to engage the hook-shaped slot in the outer ring, wherein the body portion and the hook-shaped portion form a unitary structure.

BRIEF DESCRIPTION OF THE DRAWINGS

These and other features of this invention will be more readily understood from the following detailed description of the various aspects of the invention taken in conjunction with the accompanying drawings that depict various embodiments of the disclosure, in which.

Figure 1:
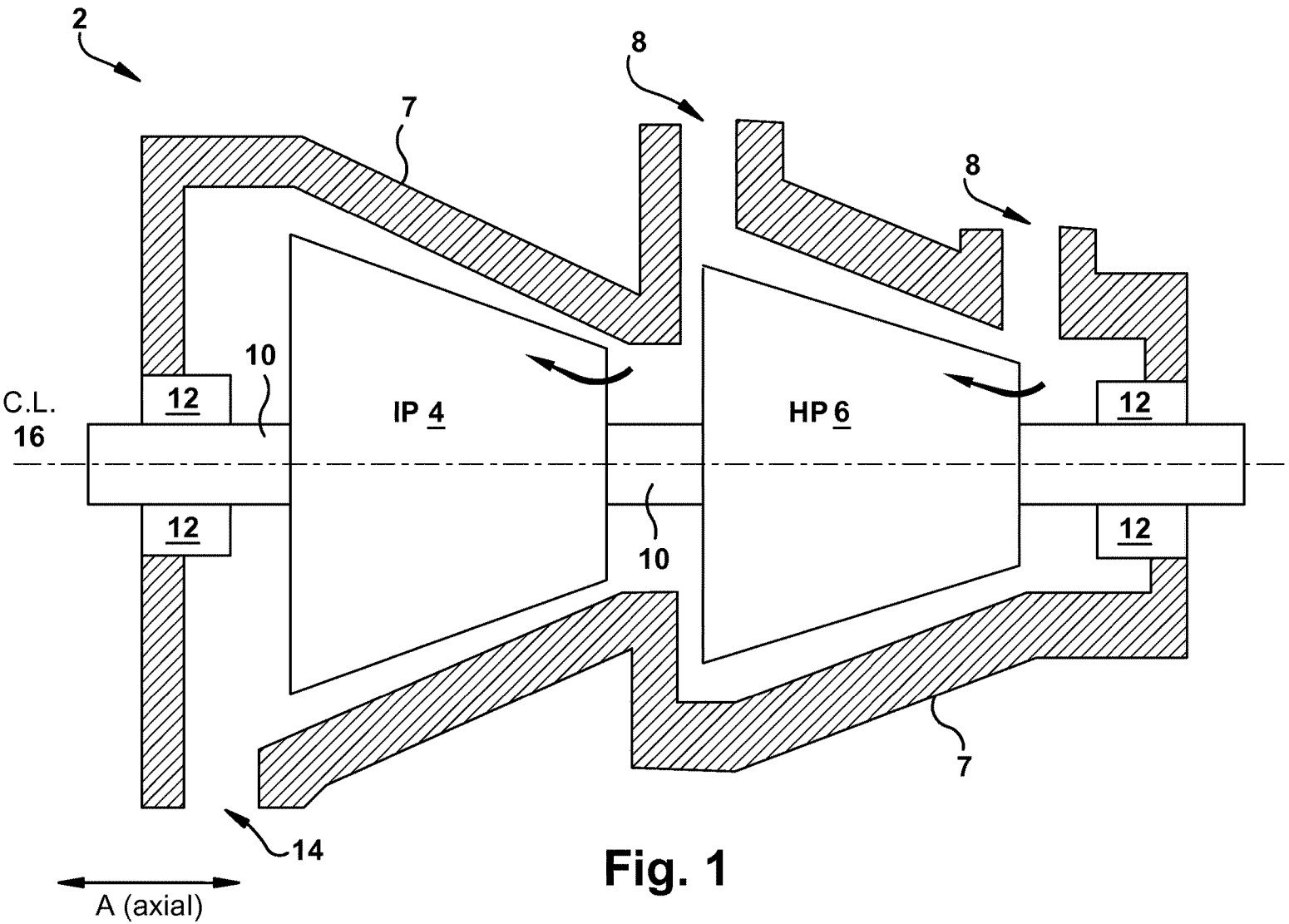
FIG. 1 shows a partial cross-sectional schematic of a steam turbine according to various embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Aspects of the disclosure provide for an austenitic segment for use in a steam turbine nozzle assembly. In particular cases, the austenitic segment can be breech-loaded (in axial direction) in the assembly.

Figure 2:
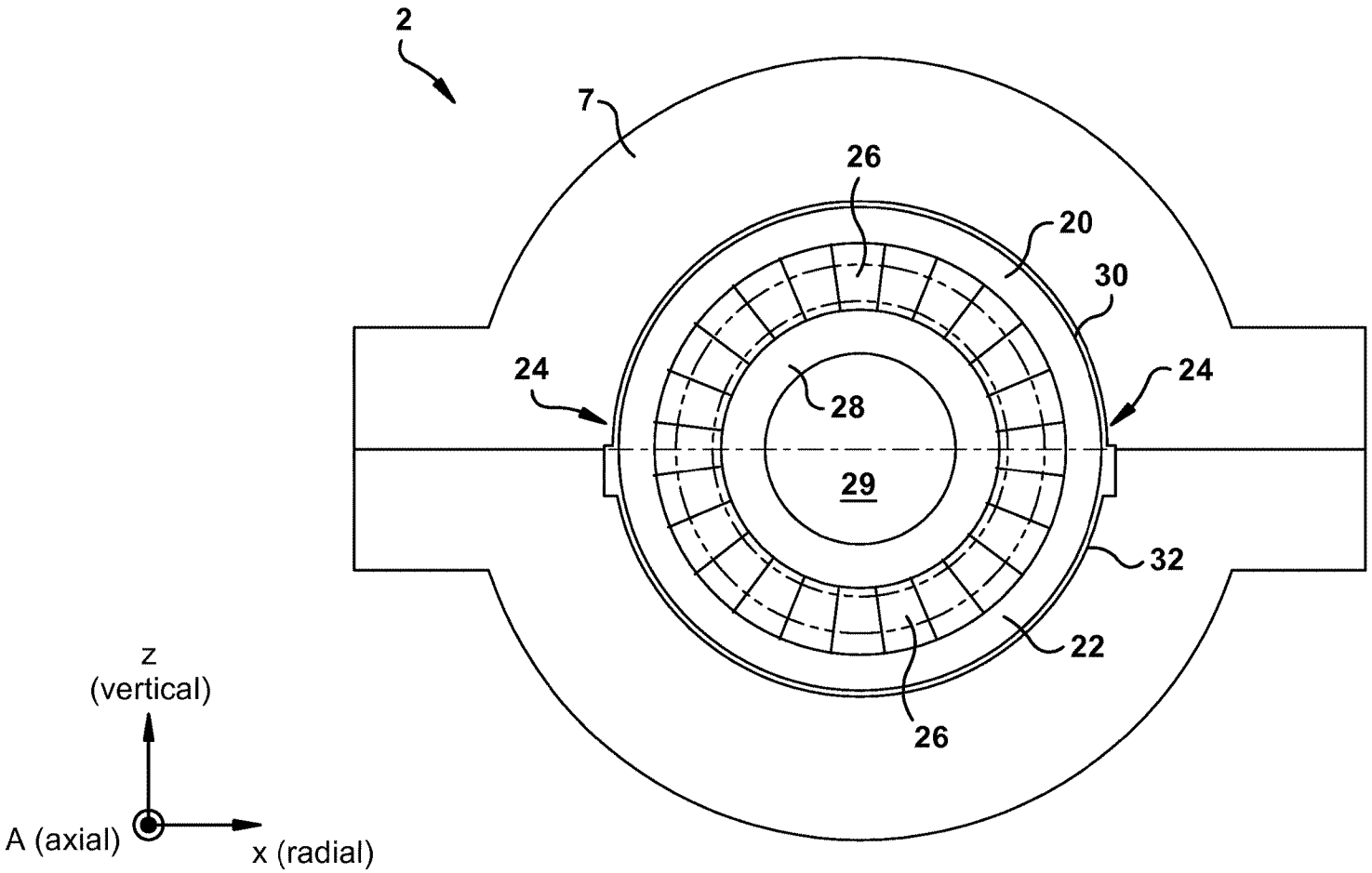
Fig. 2 (Prior Art)
FIG. 2 shows a general schematic end elevation of a pair of annular diaphragm ring segments joined at a horizontal split surface according to the prior art.

Turning to FIG. 1, a partial cross-sectional schematic view of steam turbine 2 (e.g., a high-pressure / intermediate-pressure steam turbine) is shown. Steam turbine 2 may include, for example, an intermediate pressure (IP) section 4 and a high pressure (HP) section 6. The IP section 4 and HP section 6 are at least partially encased in casing 7. Steam may enter the HP section 6 and IP section 4 via one or more inlets 8 in casing 7, and flow axially downstream from the inlet(s) 8. In some embodiments, the HP section 6 and IP section 4 are joined by a common shaft 10, which may contact bearings 12, allowing for rotation of the shaft 10, as working fluid (steam) forces rotation of the blades within each of the IP section 4 and the HP section 6. After performing mechanical work on the blades within the IP section 4 and the HP section 6, working fluid (e.g., steam) may exit through outlet 14 in casing 7. The center line (CL) 16 of the HP section 6 and IP section 4 is shown as a reference point. Both the IP section 4 and the HP section 6 can include diaphragm assemblies, which are contained within segments of casing 7. FIG. 2 shows a schematic end view of a section (e.g., IP section 4 or HP section 6) of the steam turbine 2, illustrating a diaphragm assembly, having a pair of semi-annular diaphragm ring segments 20, 22, which are joined at a horizontal joint surface 24. Diaphragm ring segments 20, 22 are housed within casing segments 30, 32, respectively (part of casing 7), which are also joined at horizontal joint surface 24. Each semi-annular diaphragm ring segment 20, 22, supports a semi-annular row of turbine nozzles 26 and an inner web 28, as is known in the art. The diaphragm ring segments 20, 22 collectively surround a rotor 29 (shown in phantom), which may be coupled to shaft 10 (FIG. 1) as is known in the art.

Figure 3:
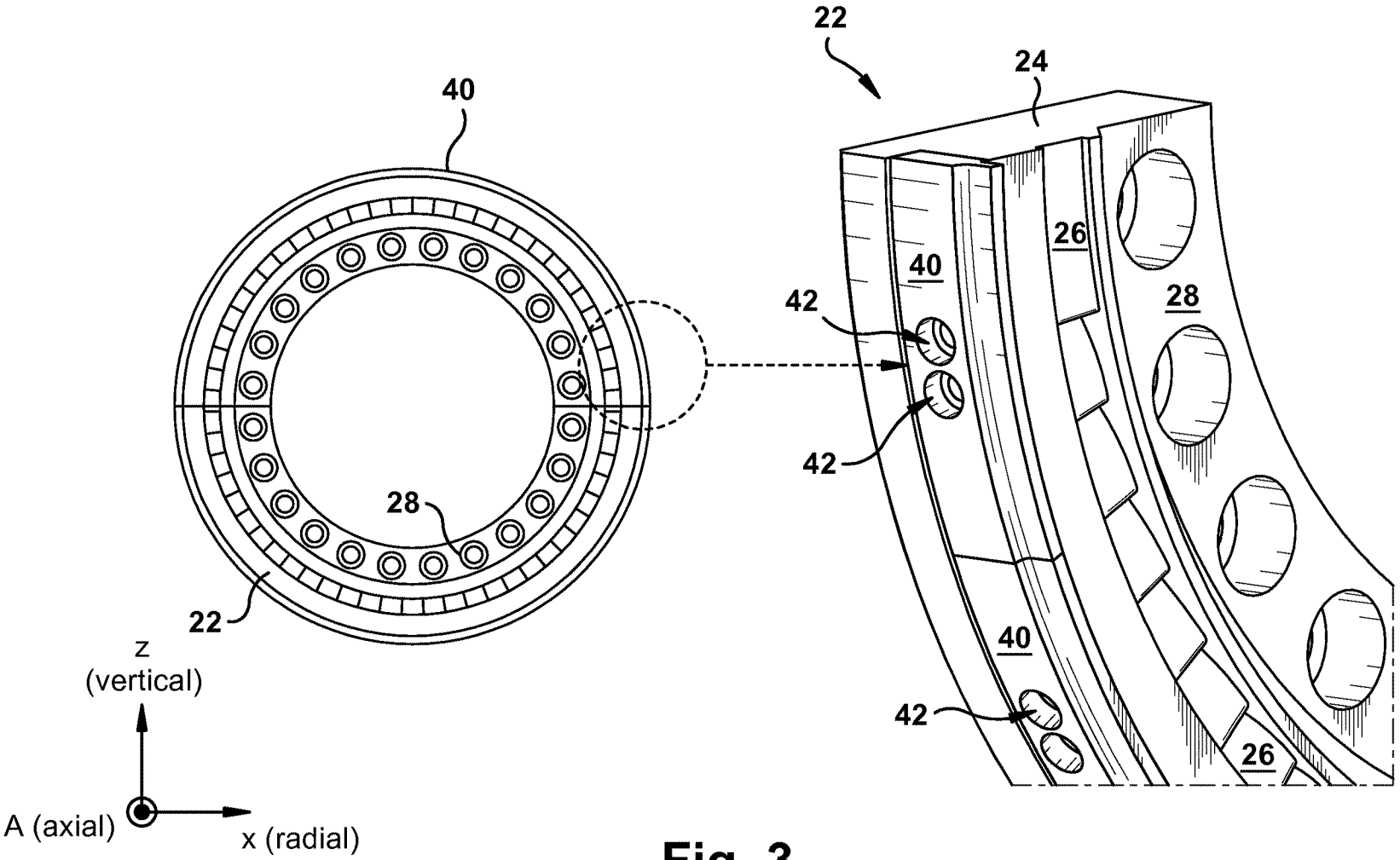
Fig. 3 (Prior Art)
FIG. 3 shows a shows an end view, and a close-up three-dimensional perspective view, of a section of the outer diaphragm ring in FIG. 2, according to the prior art.
Figure 4:
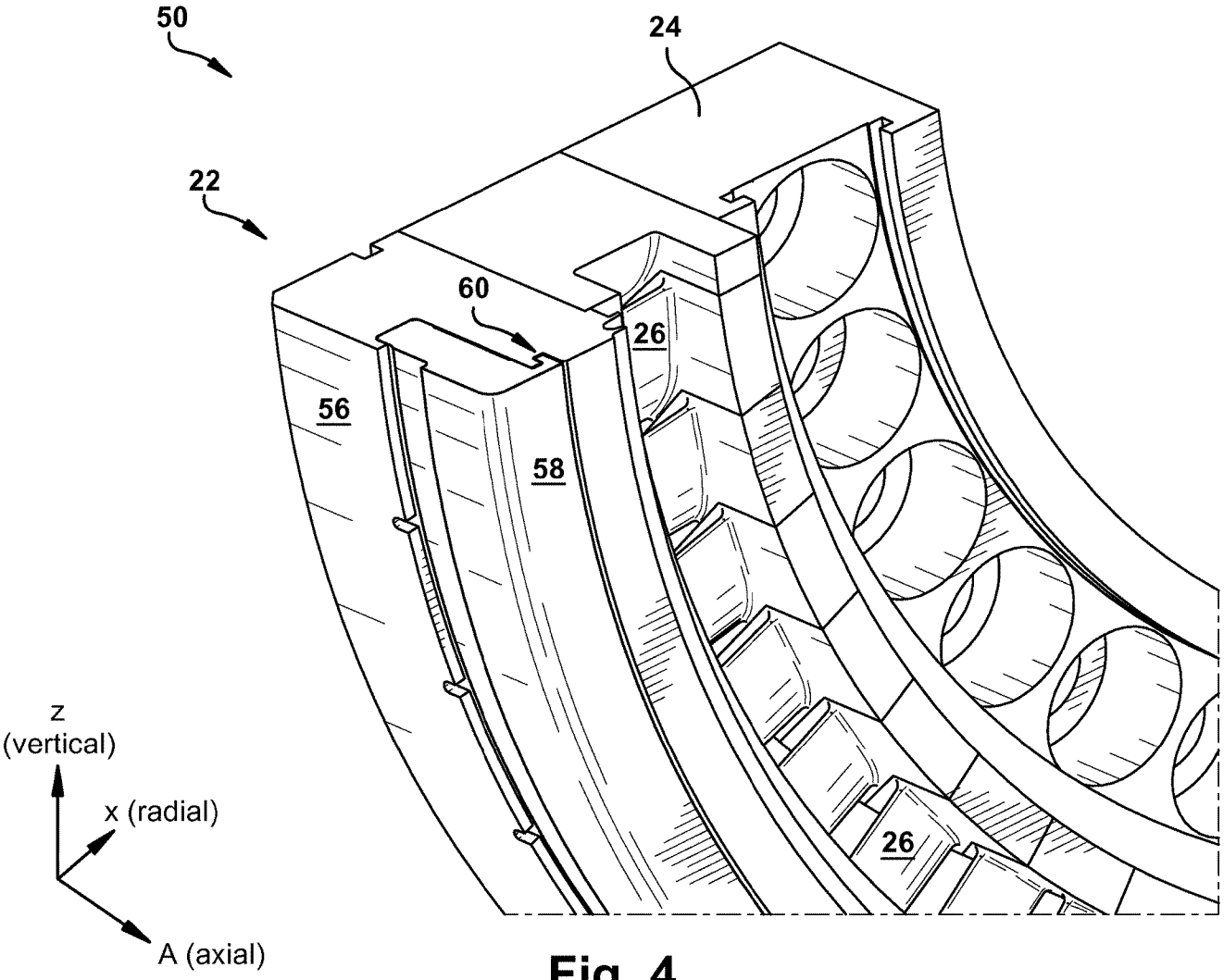
FIG. 4 shows a three-dimensional perspective view of a section of a steam turbine nozzle assembly according to various embodiments of the disclosure.
Figure 5:
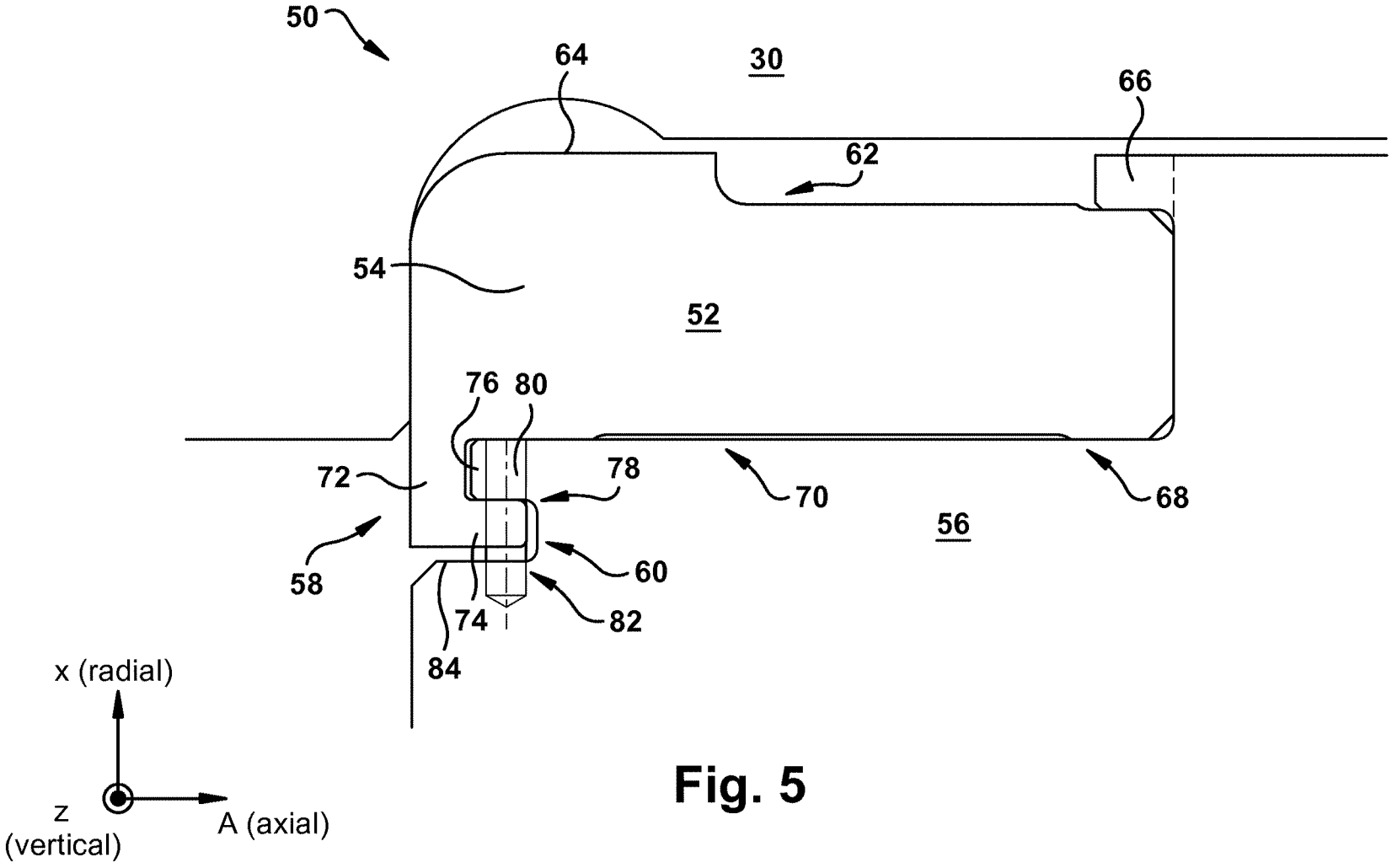
FIG. 5 shows a top view of a portion of the assembly of FIG. 4 according to various embodiments of the disclosure.
Figure 6:
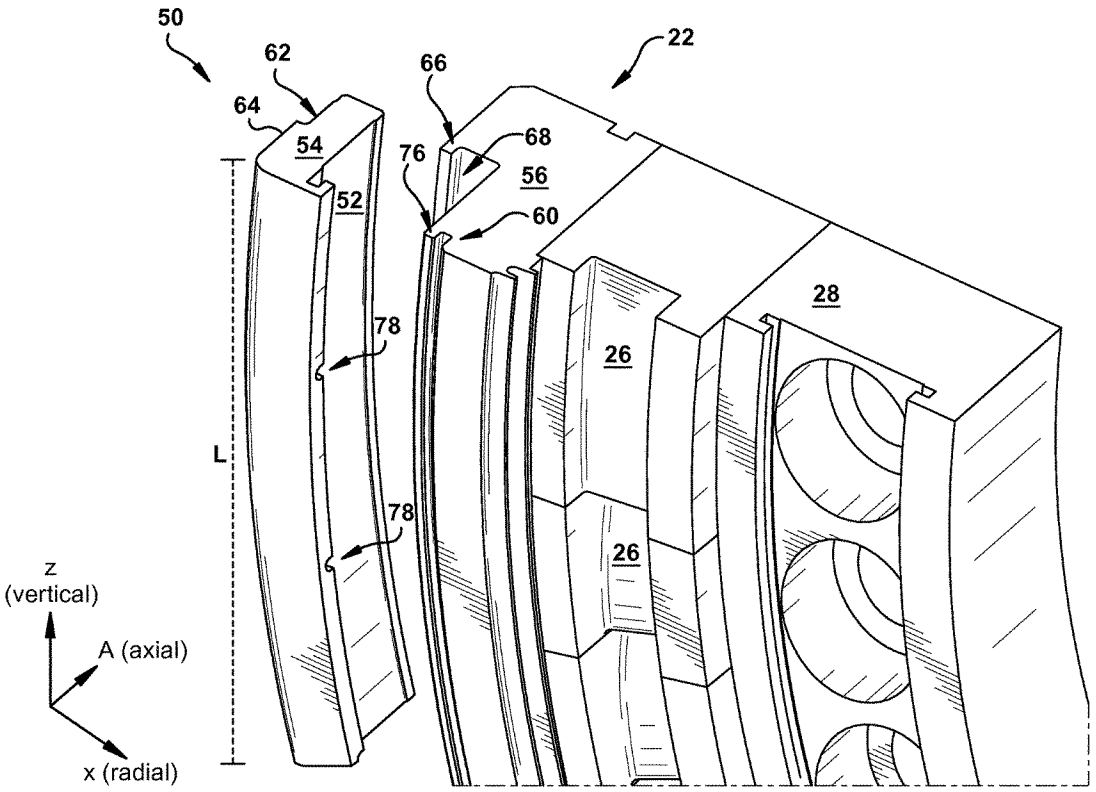
FIG. 6 shows a separated, three-dimensional perspective view, of the assembly of FIGS. 4-5, according to various embodiments of the disclosure.

FIG. 3 shows an end view, and a close-up three-dimensional perspective view, of a section of the conventional outer diaphragm ring 22 in FIG. 2, further showing conventional austenitic ring segments 40 used to hold the outer diaphragm ring 22 tightly to the casing segments 30, 32 during operation of the steam turbine 2. In this conventional assembly, the conventional austenitic ring segments 40 are bolted, either by axial bolts or radial bolts (radial bolt configuration shown) to the outer diaphragm ring 22. In order to adjust and/or replace the conventional austenitic ring segments 40 below the horizontal joint surface 24, as with adjusting the position of support bars, the upper casing segment 30 (upper half of the casing 7) and diaphragm 20 are removed in order to access the austenitic ring segments 40 below the horizontal joint surface 24 (FIG. 2). FIGS. 3-6 show different views of steam turbine support assemblies, according to both the prior art (FIG. 3), and various embodiments of the disclosure (FIGS. 4-6). As denoted in these Figures, the "z" axis represents vertical orientation, "x" represents horizontal (or radial) orientation, and the "A" axis represents axial orientation (along the axis of the turbine rotor, omitted for clarity). As used herein, the terms "axial" and/or "axially" refer to the relative position/direction of objects along axis A, which is substantially parallel with the axis of rotation of the turbomachine (in particular, the rotor section). As further used herein, the terms "radial" and/or "radially" refer to the relative position/direction of objects along axis (x), which is substantially perpendicular with axis A and intersects axis A at only one location. Additionally, the terms "circumferential" and/or "circumferentially" refer to the relative position/direction of objects along a circumference which surrounds axis A but does not intersect the axis A at any location.

Traditional austenitic segment designs, as shown in FIG. 3, are attached by a radial or axial bolt to each segment of the outer ring. As shown, each of the conventional bolted austenitic ring segments 40 include bolt holes 42 (or, simple apertures), which extend entirely through the body of those conventional bolted austenitic ring segments 40. These bolt holes 42 (apertures) must extend entirely through the ring segments 40 so that the bolt, screw, etc. passing through the hole 42 can further engage a hole within the (radially) outer ring of the diaphragm segment 22. With the conventional bolted austenitic ring segments 40, design conditions require some form of sliding fit at the bolt head so the segments 40 can expand axially without breaking the bolt. These design conditions create significant complexity during assembly/disassembly. The main function of the austenitic segments is to assure the nozzle plate outer ring (outer ring of diaphragm segment 22) is held tightly in a groove in the casing 7 (e.g., casing segment 32) during operation of the turbine 2. The use of the austenitic ring segment 40 also helps seal the axial face of the outer ring (of diaphragm segment 22) against the casing 7 (e.g., casing segment 32). This seal is achieved due to the higher coefficient of thermal expansion of the austenitic segment 40 when compared with the material forming the diaphragm segment 22 and the casing 30.

Current methods for diaphragm nozzle ring/plate maintenance may take several days to complete, this is due to the fact that in order to remove the radial or axial bolt to each austenitic ring segment 40, each nozzle plate half must be removed. Additionally, fitting the austenitic ring segments 40 to the outer ring (of diaphragm 22), and maintaining the required torque on the bolts before welding (e.g., tungsten inert gas (TIG)-tacking) the bolt heads (to prevent anti-rotation) can be time consuming. Additionally, as noted herein, the austenitic ring segment 40 cannot be removed from the diaphragm 22 without removing the diaphragm 22 from the turbine casing 30.

In contrast to the conventional nozzle assembly and plate configuration, various embodiments include an austenitic ring segment for a steam turbine nozzle assembly that has a unitary structure which joins to a steam turbine outer diaphragm ring without the need for bolts. FIG. 4 shows a three-dimensional perspective view of a section of a steam turbine nozzle assembly 50 according to various embodiments. FIG. 5 shows a top view of a portion of the assembly 50 of FIG. 4, and FIG. 6 shows a separated, three-dimensional perspective view, of the assembly 50 of FIGS. 4-5.

Referring to FIGS. 4-6, according to various embodiments, a steam turbine austenitic ring segment (or, austenitic ring segment) 52 is shown. The austenitic ring segment 52 can include a body portion 54 sized to substantially fill a pocket 68 in a steam turbine outer diaphragm ring 56 (outer diaphragm ring is part of the diaphragm 22 referenced in FIGS. 1-3). As shown, the body portion 54 has a greater circumferential length (L) than an axial depth (along axis D) or a radial width (along axis x) thereof. Additionally, the austenitic ring segment 52 can include a hook-shaped portion 58 extending radially inward (along x-axis) from the body portion 54. The hook-shaped portion 58 is sized to engage a hook-shaped slot 60 in the outer diaphragm ring 56, further described herein. As described herein, the hook-shaped portion 58 is sized to complement the hook-shaped slot 60 in the outer diaphragm ring 56, that is, the hook-shaped portion 58 substantially (completely or nearly completely) fills the hook-shaped slot 60. Further, the body portion 54 and the hook-shaped portion 58 form a unitary structure, that is, one that is void of any apertures extending therethrough. In other terms, the body portion 54 and the hook-shaped portion 58 do not include any apertures extending therethrough, which is in contrast to the conventional ring segments (e.g., as shown in FIG. 3) which include apertures for receiving retaining screws.

As shown, e.g., in FIGS. 4-6, the body portion 54 can further include a recess 62 extending partially within a radially outer side 64 of the body portion 54, along a circumferential length (L) of the body portion 54. This recess 62 can extend only partially axially along the radially outer side 64, but may extend completely along the circumferential length (L). This recess 62 can be sized to engage a lip 66 in a pocket 68 within the outer diaphragm ring 56, where the lip 66 extends at least partially axially from the outer diaphragm ring 56 toward the pocket 68. The pocket 68 can include a main pocket 70, and at least one hook-shaped slot 60 which extends from the main pocket 70.

The hook-shaped portion 58 of the austenitic ring segment 52 can further include a first flange 72 extending substantially perpendicularly from the body portion 54, and a second flange 74 extending substantially perpendicularly from the first flange 72. The first flange 72 and the second flange 74 can each be formed of a common austenitic material as the body portion 54. As shown, the hook-shaped slot 60 is formed by a flange 76 extending from the body of the outer diaphragm ring 56 in the main pocket 70.

As shown in various embodiments, the hook-shaped portion 58, in particular, the second flange 74, can include a slot 78 extending radially through the second flange 74. In various embodiments, a plurality of slots 78 are present in the second flange 74.

According to various embodiments, the nozzle assembly 50 can further include at least one retaining member 80 (FIG. 5) contacting the austenitic ring segment 52. The retaining member(s) 80 can at least partially retain the austenitic ring segment 52 in contact with the semi-annular diaphragm segment 56, by each engaging a slot 78 in the second flange 74. FIG. 5 shows this configuration in detail, illustrating how the retaining member(s) 80 each engage a slot 78 in the second flange 74. The retaining member 80 can include a radial dowel or a spring pin, and can further act to align the austenitic ring segment 52 with the pocket 68. In various embodiments, the semi-annular diaphragm segment 56 can include an aperture 82 on a radially outwardly facing surface 84 (within pocket 68), where the retaining member 80 is at least partially retained. That is, the retaining member 80 (e.g., radial dowel or spring pin) may sit within the aperture 82, which may be internally threaded in some scenarios, and can act to align/retain the austenitic ring segment 52 with the pocket 68.

As seen in FIGS. 4-6, the austenitic ring segment 52 is configured to couple, and/or decouple, with the semi-annular diaphragm segment 56 in the axial direction (A). That is, the austenitic ring segment 52 can be breech-loaded/unloaded into/out of the pocket 68, providing for reduced time in repair, maintenance and/or replacement of the ring segment 52. It is understood that a plurality of ring segments (e.g., austenitic ring segments 52) can be placed in an assembly, e.g., several segments for each section of the lower diaphragm half 22 (e.g., diaphragm segment 56), and several segments for each section of the upper diaphragm half 20 (FIG. 2).

As described herein, the assembly 50 according to various embodiments can provide an effective mechanism for locking austenitic ring segments (e.g., ring segments 52) to a diaphragm (e.g., diaphragm segment 56) without the use of bolts or other fasteners. That is, the austenitic ring segments 52 can engage the diaphragm segment 56 without being fastened (e.g., bolted, screwed, clamped, etc.) to the diaphragm segment 56. This can eliminate the need to reach below the horizontal joint surface 24 to actuate fasteners (e.g., bolt/unbolt bolts, screw/unscrew screws, etc.).

In various embodiments, these austenitic ring segments 52 can be employed in a first stage of the turbine 2, e.g., where the highest pressure differential exists in the machine. As described herein, the use of an austenitic material for the ring segments 52 allows the ring segments 52 to expand more rapidly under heat than the material of the diaphragm segment 56 (e.g., steel), imparting axial force on the diaphragm segment 56. The austenitic material, as is known in the art, includes gamma-phase iron (γ-Fe), which is a metallic, non-magnetic allotrope of iron or a solid solution of iron, with an alloying element.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine austenitic ring segment comprising:

a body portion sized to substantially fill a pocket in a steam turbine outer diaphragm ring, the body portion having a greater circumferential length than an axial depth or a radial width thereof; and a hook-shaped portion extending radially inward from the body portion, the hook-shaped portion sized to engage a hook-shaped slot in the steam turbine outer diaphragm ring, wherein the body portion and the hook-shaped portion form a unitary structure.

2. The steam turbine austenitic ring segment of claim 1, wherein the hook-shaped portion complements the hook-shaped slot in the steam turbine outer diaphragm ring.

3. The steam turbine austenitic ring segment of claim 1, wherein the unitary structure is void of any hole extending therethrough.

4. The steam turbine austenitic ring segment of claim 1, wherein the body portion further includes a recess extending partially within a radially outer side of the body portion, along the circumferential length of the body portion.

5. The steam turbine austenitic ring segment of claim 1, wherein the hook-shaped portion includes:

a first flange extending substantially perpendicularly from the body portion; and a second flange extending substantially perpendicularly from the first flange.

6. The steam turbine austenitic ring segment of claim 5, wherein each of the first flange and the second flange is formed of a common austenitic material as the body portion.

7. A steam turbine nozzle assembly comprising:

a turbine casing;

a semi-annular diaphragm segment having an outer ring, the semi-annular diaphragm segment at least partially housed within the turbine casing, the semi-annular diaphragm segment having a horizontal joint surface and a pocket below the horizontal joint surface, the pocket including a main pocket and at least one hook-shaped slot extending from the main pocket; and an austenitic ring segment coupled with the semi-annular diaphragm segment, the austenitic ring segment having:

a body portion sized to substantially fill the main pocket in the outer ring, the body portion having a greater circumferential length than an axial depth or a radial width thereof; and a hook-shaped portion extending from the body portion radially inward, the hook-shaped portion sized to engage the hook-shaped slot in the outer ring, wherein the body portion and the hook-shaped portion form a unitary structure.

8. The stem turbine nozzle assembly of claim 7, further comprising a retaining member contacting the austenitic ring segment, the retaining member at least partially retaining the austenitic ring segment in contact with the semi-annular diaphragm segment.

9. The steam turbine nozzle assembly of claim 8, wherein the semi-annular diaphragm segment includes an aperture on a radially outwardly facing surface, and wherein the retaining member is at least partially retained in the aperture.

10. The steam turbine nozzle assembly of claim 7, wherein the hook-shaped portion complements the hook-shaped slot in the steam turbine outer diaphragm ring.

11. The steam turbine nozzle assembly of claim 7, wherein the unitary structure is void of any hole extending therethrough.

12. The steam turbine nozzle assembly of claim 7, wherein the body portion further includes a recess extending partially within a radially outer side of the body portion, along the circumferential length of the body portion.

13. The steam turbine nozzle assembly of claim 7, wherein the hook-shaped portion includes:

a first flange extending substantially perpendicularly from the body portion; and a second flange extending substantially perpendicularly from the first flange.

14. The steam turbine nozzle assembly of claim 13, wherein each of the first flange and the second flange is formed of a common austenitic material as the body portion.

15. The steam turbine nozzle assembly of claim 7, wherein the austenitic ring segment is configured to at least one of couple or decouple with the semi-annular diaphragm segment in an axial direction.

16. A steam turbine comprising:

a rotor;

a turbine casing at least partially surrounding the rotor;

a semi-annular diaphragm segment having an outer ring, the semi-annular diaphragm segment at least partially housed within the turbine casing around the rotor, the semi-annular diaphragm segment having a horizontal joint surface and a pocket below the horizontal joint surface, the pocket including a main pocket and at least one hook-shaped slot extending from the main pocket; and an austenitic ring segment coupled with the semi-annular diaphragm segment, the austenitic ring segment having:

a body portion sized to substantially fill the main pocket in the outer ring, the body portion having a greater circumferential length than an axial depth or a radial width thereof; and a hook-shaped portion extending from the body portion radially inward, the hook-shaped portion sized to engage the hook-shaped slot in the outer ring, wherein the body portion and the hook-shaped portion form a unitary structure.

17. The stem turbine of claim 16, further comprising a retaining member contacting the austenitic ring segment, the retaining member at least partially retaining the austenitic ring segment in contact with the semi-annular diaphragm segment.

18. The steam turbine of claim 17, wherein the semi-annular diaphragm segment includes an aperture on a radially outwardly facing surface, and wherein the retaining member is at least partially retained in the aperture.

19. The steam turbine of claim 16, wherein the unitary structure is void of any hole extending therethrough.

20. The steam turbine of claim 16, wherein the austenitic ring segment is configured to at least one of couple or decouple with the semi-annular diaphragm segment in an axial direction.

* * * * *